US008079872B2

(12) United States Patent
Ju

(10) Patent No.: US 8,079,872 B2
(45) Date of Patent: Dec. 20, 2011

(54) INDIVIDUALLY SHIELDED TERMINALS WITHIN INSULATING LUMPS

(75) Inventor: Ted Ju, Keelung (TW)

(73) Assignee: Lotes Co., Ltd., Keelung (TW)

( * ) Notice: Subject to any disclaimer, the term of this patent is extended or adjusted under 35 U.S.C. 154(b) by 0 days.

(21) Appl. No.: 13/046,058

(22) Filed: Mar. 11, 2011

(65) Prior Publication Data

US 2011/0159734 A1 Jun. 30, 2011

Related U.S. Application Data

(63) Continuation of application No. 12/318,603, filed on Dec. 31, 2008, now Pat. No. 7,959,466, and a continuation-in-part of application No. 11/832,231, filed on Aug. 1, 2007, now abandoned.

(51) Int. Cl.
*H01R 13/648* (2006.01)

(52) U.S. Cl. ..... 439/607.03

(58) Field of Classification Search ..... 439/607.03, 439/607.05, 607.1
See application file for complete search history.

(56) References Cited

U.S. PATENT DOCUMENTS 6,388,208 B1 * 5/2002 Kiani et al. ..... 174/266
6,478,624 B2 * 11/2002 Ramey et al. ..... 439/607.1

* cited by examiner

*Primary Examiner* — Vanessa Girardi
(74) *Attorney, Agent, or Firm* — Rosenberg, Klein & Lee

(57) ABSTRACT

An electrical connector includes an insulating body, a plurality of terminal units, a plurality of insulating lump units, and a plurality of shielding units. The insulating body has a plurality of receiving holes arranged thereon. Each of the insulating lump units has a terminal fixing slot for mounting the corresponding terminal unit there-through. Each of the shielding units is respectively disposed on the periphery of the corresponding insulating lump unit without contacting the terminal unit mounted thereon. The terminals are disposed in the receiving holes of the insulating body. The insulating lump units can prevent shorting between the terminals and the shielding units, while the shielding units can enhance the anti-EMI capability of the instant connector.

5 Claims, 3 Drawing Sheets

INDIVIDUALLY SHIELDED TERMINALS WITHIN INSULATING LUMPS

CROSS REFERENCE TO RELATED APPLICATION

This application is a Continuation of co-pending application Ser. No. 12/318,603, filed on Dec. 31, 2008, the entire contents of which are hereby incorporated by reference and for which priority is claimed under 35 U.S.C. §120. The application Ser. No. 12/318,603 is a continuation-in-part of U.S. application Ser. No. 11/832,231, filed on Aug. 1, 2007 and entitled "electrical connector", now abandoned.

BACKGROUND OF THE INVENTION

1. Field of the Invention

The present invention relates to an electrical connector, and in particular to an electrical connector having a shielding layer for preventing Electromagnetic Interference (EMI).

2. Description of the Prior Art

As computer and digital technology advance, the demand for higher data transmission rate has been rapidly growing. To obtain the high data transmission speed, there are a number of electrical connectors with high terminal density available on the market such as LGA (Land Grid Array) connector. However, how to protect the transmission of data from EMI is an issue in the development of high terminal density technology. The ordinary method for preventing EMI is to install a layer of a metal or set a plated film on the surface of the insulating body to improve the quality of EMI protection. However, because the metal layer is only disposed on the surface of the insulating body, the influence of EMI between terminals to the properties of electrical connector are also huge when the electrical connectors have the high terminal density, thereby it reduces the ability of the electrical connector to transmit signals. In view of this, the inventor proposes the present invention to overcome the above problems.

SUMMARY OF THE INVENTION

One object of the present invention is to provide an electrical connector that reduces EMI efficiently between terminals and prevents the terminals from contacting the shielding layers that are disposed in the plurality of terminal-receiving holes.

One aspect of the present invention provides an electrical connector which comprises an insulating body having a plurality of terminal slots for fixing a plurality of terminals therein. An EMI shielding layer is disposed on the surface defining each terminal shot, and an insulating layer is correspondingly disposed over each EMI shielding layer. Each terminal unit is disposed in the terminal slot of the insulating body in contact with the insulating layer thereof.

Another aspect of the present invention provides and electrical connector which comprises an insulating body having a plurality of receiving holes arranged on a surface thereof, a plurality of terminal units, and a plurality of insulating lumps. Each insulating lump has a terminal fixing slot for partially receiving a terminal unit therein. An EMI shielding unit disposed on the peripheral surface of the insulating lump without contacting the terminal unit. Each insulating lump having the corresponding terminal unit partially received therein is then disposed in the receiving hole of the insulating body.

The advantages of the present invention lie in that the shielding layers are mounted on the insulating body and the insulating layers are mounted on the shielding layers, thereby reducing EMI between terminals and preventing the terminals from contacting the shielding layers in the terminal-receiving holes. By preventing EMI and static electricity the present invention also prevents the terminals from grounding and contacting each other. As a result, the stability of the electrical connector is improved, the structure is simple, and the cost is reduced.

DETAILED DESCRIPTION OF THE INVENTION

Figure 1:
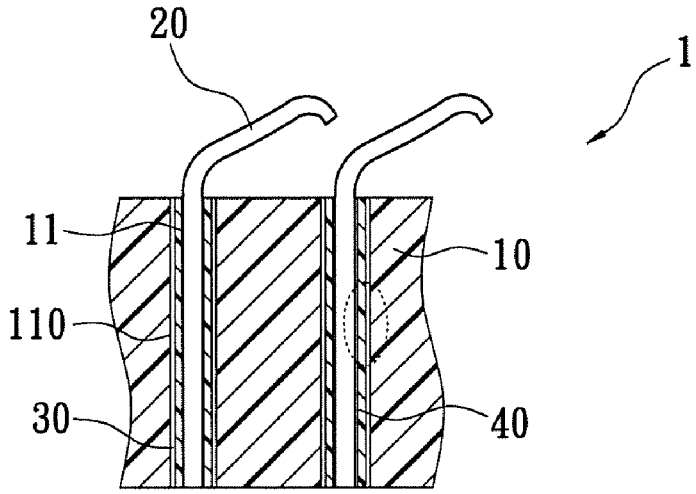
FIG. 1 is a cross-sectional view showing a portion of the electrical connector of the present invention.
Figure 2:
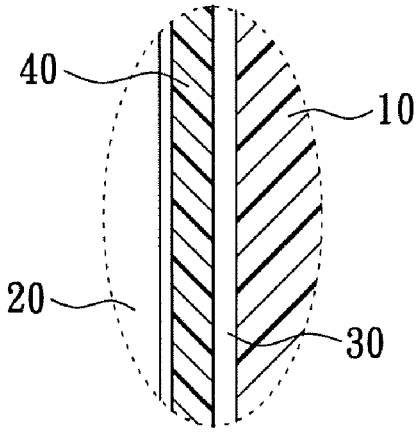
FIG. 2 is an enlarged perspective view showing a portion of the electrical connector of the present invention.

Please refer to FIG. 1 and FIG. 2, in which the present invention of an electrical connector 1 is shown. The electrical connector 1 includes an insulating body 10 and a plurality of terminals 20. The insulating body 10 has a plurality of terminal-receiving holes 11 and the terminals 20 are set in the terminal-receiving holes 11. A plurality of shielding layers 30 are attached to an inner wall 110 of each of the terminal-receiving holes 11. The shielding layers 30 can prevent crosstalk that occurs due to the near gap of the terminals 20. A plurality of insulating layers 40 that are covered with and attached to the shielding layers 30 prevent the terminals 20 from contacting the shielding layers 30.

The shielding layers 30 that are disposed around the terminal-receiving holes 11 and correspond to the shape of the terminal-receiving holes 11 can be metal housings. The shielding layers 30 also can be metal films plated to the inner wall 110 of the terminal-receiving holes 11 by using a vacuum sputtering or a coating method. The shielding layers 30 that are attached to the inner wall 110 of the terminal-receiving holes 11 can further be foil made of good ductility metal.

The shielding layers 30 are covered with the insulating layers 40. The insulating layers 40 can be plastic housings or formed on the shielding layers 30 by molding. The insulating layers 40 also can be insulating coatings applied to the shielding layers 30. Furthermore, the insulating layers 40 can be plastic films that are attached to the shielding layers 30, thereby preventing the terminals 20 from contacting the shielding layers 30.

Figure 3:
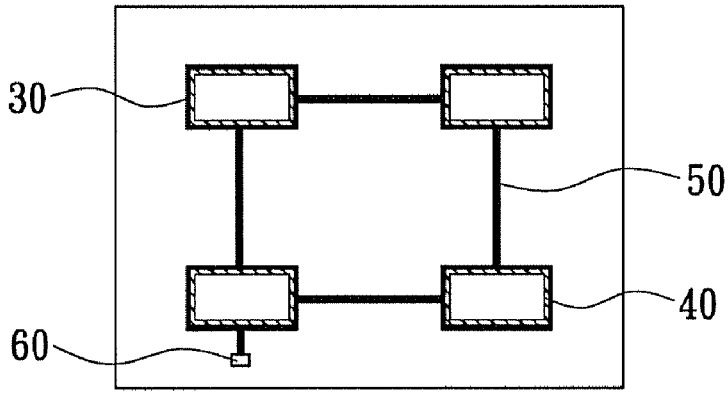
FIG. 3 is an enlarged perspective view of the top view showing a portion of the electrical connector while the terminals are uninstalled therein of the present invention.
Figure 4:
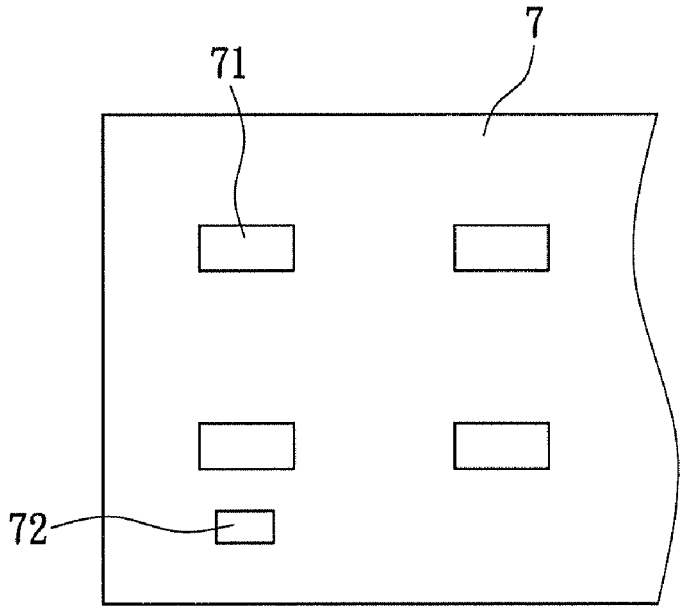
FIG. 4 is an enlarged perspective view showing a portion of the circuit board connected to electrical connectors of the present invention.

Please refer to FIG. 3 and FIG. 4, the electrical connector 1 connects to a circuit board 7. Furthermore, the electrical connector includes a conductive layer 50 that is electrically connected to the shielding layers 30 in the terminal-receiving holes 11. The circuit board 7 has a contact pad 71 and a grounding circuit 72. The conductive portion 50 is connected to a grounding circuit 72 of the circuit board via a conductive sheet 60; therefore the shielding layers 30 are electrical connected with the grounding circuit 72 of the circuit board 7.

The present invention prevents the terminals 20 from contacting the shielding layers 30 and prevents signal failure via the insulating layers 40 that are mounted on the shielding layers 30. The stability of the electrical connector 1 is improved.

Figure 5:
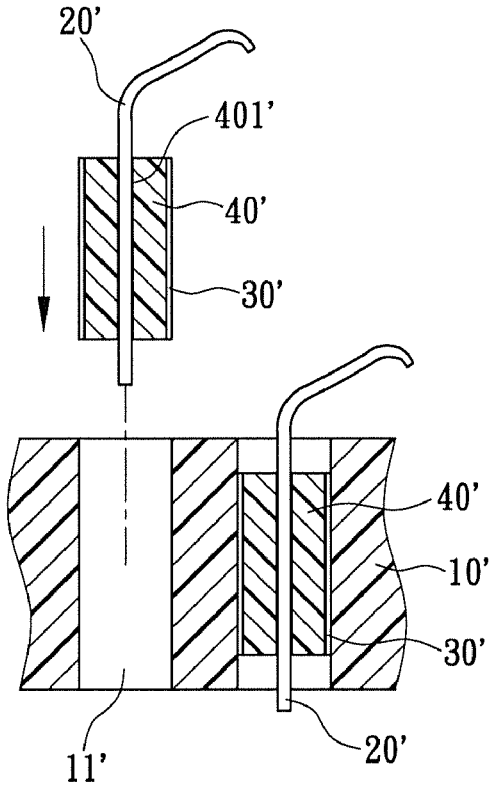
FIG. 5 is an enlarged sectional view showing another embodiment of the present invention.
Figure 6:
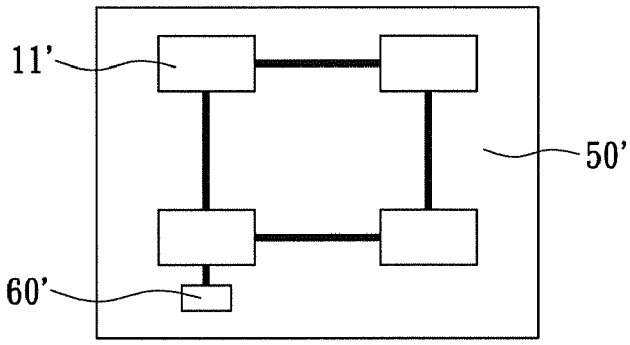
FIG. 6 is an enlarged perspective view showing electrical connector with no terminals and insulating lumps of the present invention.

Please refer to FIG. 5, it shows another embodiment of the present invention. The electrical connector includes an insulating body 10'. The difference between this embodiment and the above embodiment is that there is no metal layer planed in the receiving holes 11'. The electrical connector includes a plurality of insulating lumps 40'. Each of the insulating lumps 40' has a terminal fixing slot 401'. Each of the terminal units 20' is disposed through the terminal fixing slot 401' of the corresponding lump 40' and fixed thereon. A plurality of shielding units 30' for preventing EMI are correspondingly mounted on the periphery of each insulating lump 40' without contacting the terminal units 20' disposed thereon. Preferably, the shielding units 30' are disposed on the periphery of the insulating lumps 40' by using a vacuum sputtering or a coating method. However, the methods need not be limited to the above techniques. Alternatively, the shielding units 30' can be metal housings coveringly arranged on the periphery of the insulating lumps 40'. The shielding units 30' can also be made of metal foils adhered to the periphery of the insulating lumps 40'. Even further, the shielding units 30' can be metal films plated on the periphery of the insulating lumps 40'. However, it is important to keep the shielding unit 30' from establishing electrical contact with the terminal unit 20' to avoid shorting in the connector. The insulating lumps 40', with the corresponding terminal units 20' respectively disposed therethrough, are disposed in the receiving holes 11' of the insulating body 10'. In other words, each insulating lump 40' is arranged between the terminal unit 20' and the corresponding shielding unit 30'. Moreover, a conductive layer 50' may be disposed at the bottom of the electrical connector to establish electrical connection with the shielding units 30' in the receiving holes 11' (while the insulating lumps 40' having the terminal units 20' mounted thereon are set in the receiving holes 11'). Therefore, when the electrical connector is connected to the circuit board 7 (please refer to FIG. 4), the conductive layer 50' can be electrically connected to the grounding circuit 72 of the circuit board 7 via a conductive sheet 60'. Thus, the instant embodiment can achieve the same EMI shielding effect as the previous embodiment. Furthermore, the process of mounting the shielding units 30' onto the periphery of the insulating lumps 40' may be more practically cost-efficient than disposing the shielding layers 30 on the inner wall of the receiving holes 11.

What is claimed is:

1. An individually shielded terminals within insulating lumps, comprising:

(a) an insulating body having a plurality of receiving holes;

(b) a plurality of terminal units;

(c) a plurality of insulating lumps, each insulating lump having a terminal fixing slot for mounting the corresponding terminal unit therethrough, each terminal unit being in direct contact with the corresponding insulating lump;

(d) a plurality of shielding units, each being respectively disposed on the periphery of each corresponding insulating lump without contacting the terminal unit; and (e) a plurality of conductive layers respectively electrically connected to the plurality of shielding units;

wherein each insulating lump is disposed between each corresponding terminal unit and each corresponding receiving hole, wherein each terminal unit is partially received in the terminal fixing slot of the corresponding insulating lump; and wherein each of the insulating lumps is fixedly disposed in the corresponding receiving hole in mutual electrical isolation.

2. The individually shielded terminals within insulating lumps as claimed in claim 1, wherein each of the shielding units is a metal housing disposed on the periphery of the corresponding insulating lump.

3. The individually shielded terminals within insulating lumps as claimed in claim 1, wherein each of the shielding units is a metal film plated on the periphery of the corresponding insulating lump.

4. The individually shielded terminals within insulating lumps as claimed in claim 1, wherein each of the shielding units is a metal foil adhered to the periphery of the corresponding insulating lump.

5. The individually shielded terminals within insulating lumps as claimed in claim 1, wherein the conductive layer is electrically connected to a grounding circuit of a circuit board.

* * * * *